US008820527B2

(12) United States Patent
Chan et al.

(10) Patent No.: US 8,820,527 B2
(45) Date of Patent: Sep. 2, 2014

(54) BLOCKING ELEMENT AND ITS USE IN PROTECTIVE STRUCTURE

(71) Applicant: AU Optronics Corp., Hsin-Chu (TW)

(72) Inventors: Tai-Ling Chan, Hsin-Chu (TW); Chung-Yu Mao, Hsin-Chu (TW); Chung-Kuan Ting, Hsin-Chu (TW)

(73) Assignee: Au Optronics Corp., Hsin-Chu (TW)

( * ) Notice: Subject to any disclaimer, the term of this patent is extended or adjusted under 35 U.S.C. 154(b) by 21 days.

(21) Appl. No.: 13/633,607

(22) Filed: Oct. 2, 2012

(65) Prior Publication Data

US 2014/0050870 A1 Feb. 20, 2014

(30) Foreign Application Priority Data

Aug. 15, 2012 (TW) ..... 101129622 A

(51) Int. Cl.
*B65D 85/48* (2006.01)
*B65D 81/02* (2006.01)

(52) U.S. Cl.
USPC ..... 206/453; 206/523; 206/586; 206/591

(58) Field of Classification Search
CPC .... B65D 5/5033; B65D 5/5047; B65D 5/508; B65D 5/5088; B65D 5/509; B65D 81/054; B65D 81/057; B65D 81/107; B65D 81/1075; B65D 2581/05; B65D 2581/051; B65D 2581/053; B65D 2581/055; B65D 85/30; B65D 85/48
USPC ..... 206/453, 523, 586, 590, 591; 248/345.1
See application file for complete search history.

(56) References Cited

U.S. PATENT DOCUMENTS

| | | | | | |
|---|---|---|---|---|---|
| 2,006,224 | A * | 6/1935 | Weber et al. | ..... | 206/586 |
| 2,663,417 | A * | 12/1953 | Kincaid | ..... | 206/453 |
| 3,064,801 | A * | 11/1962 | Linnell | ..... | 206/453 |
| 3,980,221 | A * | 9/1976 | Okada | ..... | 206/586 |
| 5,529,187 | A * | 6/1996 | DeNola | ..... | 206/485 |
| 6,675,970 | B1 * | 1/2004 | Nemoto | ..... | 206/586 |
| 2009/0065385 | A1 | 3/2009 | Kakuta et al. | | |

FOREIGN PATENT DOCUMENTS

| | | | | |
|---|---|---|---|---|
| CN | 201228135 Y | 4/2009 | | |
| CN | 102582962 A | 7/2012 | | |
| FR | 2351879 A1 * | 12/1977 | ..... | B65D 81/10 |

OTHER PUBLICATIONS

State Intellectual Property Office of the People's Republic of China, "Office Action", China, Mar. 3, 2014.

* cited by examiner

*Primary Examiner* — Bryon Gehman
(74) *Attorney, Agent, or Firm* — Morris Manning & Martin LLP; Tim Tingkang Xia, Esq.

(57) ABSTRACT

The disclosure provides a blocking element and its use in a protective structure. The blocking element includes a base and a first blocking plate. The base includes a surface and a recession formed downwardly towards the surface. The first blocking plate is connected to a first cross-connect part of the recession. The first blocking plate is used for pivoting on the first cross-connect part and includes a first blocking position and a first closing position in relative to the first cross-connect part. When the first blocking plate is at the first blocking position, a first blocking part of the first blocking plate protrudes from the surface. When the first blocking plate is pressed towards the recession to the first closing position by an external force, at least one portion of the first blocking part is contained in the recession.

17 Claims, 12 Drawing Sheets

BLOCKING ELEMENT AND ITS USE IN PROTECTIVE STRUCTURE

CROSS-REFERENCE TO RELATED APPLICATIONS

This non-provisional application claims priority under 35 U.S.C. §119(a) on Patent Application No(s). 101129622 filed in Taiwan, R.O.C. on Aug. 15, 2012, the entire contents of which are hereby incorporated by reference.

BACKGROUND OF THE INVENTION

1. Technical Field

The present disclosure relates to a blocking element and its use in a protective structure, and more particularly to a blocking element and its use in a protective structure with lateral support.

2. Related Art

Lately, as for an apparatus for packaging, in order to prevent need-to-be-packed items from collision or damage, a protective structure is generally adopted to prevent the items from collision. In detail, the protective structure forms multiple containers, each of the items is disposed in the each of the respective containers, and all of the items are separated from each other by adjacent sidewalls of the containers. Therefore, such protective structure may prevent the items from colliding with each other and damage by external force.

However, the arrangement of disposing the single item in the single container not only occupies too much space for storage but also needs sufficient protective structures to avoid the collision. In this way, manufacturers must require greater storage space, more transportation vehicles and more protecting costs for storage and transportation. Under the circumstances that the cost of products must be reduced in competitive market recently, the above-mentioned protecting method for items is not competitive than other products. Therefore, developing a protective structure with lower cost is the problem that manufacturer dedicates to solve.

SUMMARY OF THE INVENTION

An embodiment discloses a blocking element comprising a base and a first blocking plate. The base includes a surface and a recession formed downwardly towards the surface. The first blocking plate is connected to a first cross-connect part of the recession. The first blocking plate is used for pivoting on the first cross-connect part and includes a first blocking position and a first closing position in relative to the first cross-connect part. When the first blocking plate is at the first blocking position, a first blocking part of the first blocking plate protrudes from the surface. When the first blocking plate is pressed towards the recession to the first closing position by an external force, at least one portion of the first blocking part is contained in the recession.

Another embodiment discloses a protective structure comprising a container and a blocking element. The container includes a bottom surface, a first lateral surface and a second lateral surface. The blocking element is disposed on the bottom surface and includes an edge in the vicinity of the second lateral surface. The edge keeps a distance from the second lateral surface. The blocking element is used for containing a workpiece disposed between the edge and the second lateral surface. The blocking element comprises a recession and a first blocking plate. The recession is formed downwardly towards the bottom surface. The first blocking plate is connected to a first cross-connect part of the recession. The first blocking plate is used for pivoting on the first cross-connect part and includes a first blocking position and a first closing position in relative to the first cross-connect part. When the first blocking plate is at the first blocking position, a first blocking part of the first blocking plate protrudes from the bottom surface. When the first blocking plate is pressed towards the recession to the first closing position by an external force, at least one portion of the first blocking part is contained in the recession.

Yet another embodiment discloses a protective structure comprising a bottom separating element, a first side separating element, a second side separating element and a blocking element. The bottom separating element includes a first surface and a second surface opposite to each other, and the bottom separating element includes at least one through holes penetrating through the first surface and the second surface. The first side separating element and the second side separating element are disposed on two opposite sides of the bottom separating element respectively and form a container with the first surface together. The blocking element is disposed on the second surface. The blocking element includes an edge in the vicinity of the second side separating element. The edge keeps a distance from the second side separating element. The blocking element is used for containing a workpiece disposed between the edge and the second side separating element. The blocking element comprises a base and a first blocking plate. The base includes a surface and a recession formed downwardly towards the surface. The first blocking plate is connected to a first cross-connect part of the recession. The first blocking plate is exposed from the through hole. The first blocking plate is used for pivoting on the first cross-connect part and includes a first blocking position and a first closing position in relative to the first cross-connect part. When the first blocking plate is at the first blocking position, a first blocking part of the first blocking plate protrudes from the first surface through the through hole. When the first blocking plate is pressed towards the recession to the first closing position, at least one portion of the first blocking parties is contained in the recession.

BRIEF DESCRIPTION OF THE DRAWINGS

The present disclosure will become more fully understood from the detailed description given herein below for illustration only, and thus are not limitative of the present disclosure, and wherein.

DETAILED DESCRIPTION OF THE INVENTION

The detailed features and advantages of the disclosure are described below in great detail through the following embodiments, the content of the detailed description is sufficient for those skilled in the art to understand the technical content of the present disclosure and to implement the disclosure there accordingly. Based upon the content of the specification, the claims, and the drawings, those skilled in the art can easily understand the relevant objectives and advantages of the disclosure.

Figure 1A:
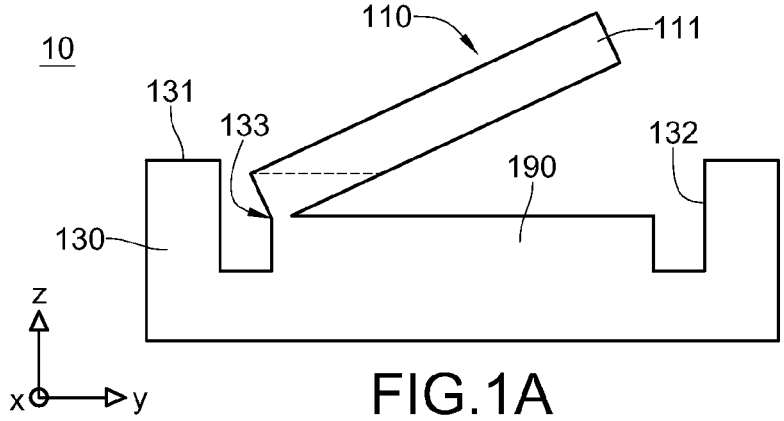
FIG. 1A depicts a cross-sectional view of a blocking element at a blocking position according to an embodiment of the disclosure.
Figure 1B:
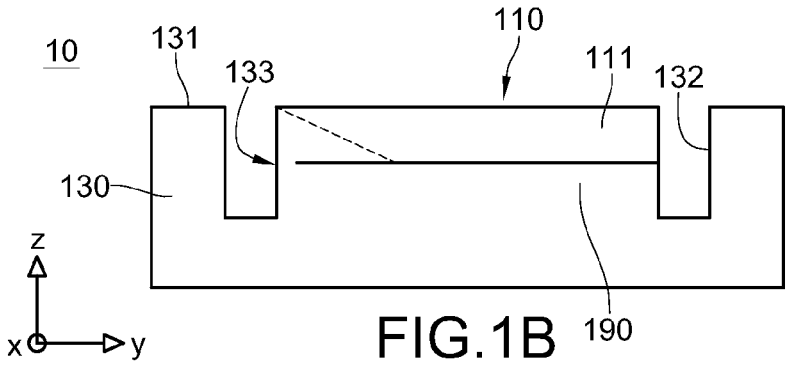
FIG. 1B depicts a cross-sectional view of the blocking element in FIG. 1A at a closing position.

Please refer to FIGS. 1A and 1B, FIG. 1A depicts a cross-sectional view of a blocking element at a blocking position according to an embodiment of the disclosure, and FIG. 1B depicts a cross-sectional view of the blocking element in FIG. 1A at a closing position. A blocking element 10 comprises a base 130 and a blocking plate 110. The base 130 includes a surface 131 and a recession 132. The recession 132 is formed downwardly towards the surface 131. The base 130 includes a bump 190 which is disposed in the inside the recession 132. The blocking plate 110 is connected to a cross-connect part 133 of the bump 190 of the recession 132. The blocking plate 110 is used for pivoting on the cross-connect part 133 and includes a blocking position and a closing position in relative to the cross-connect part 133. When the blocking part 111 is at the blocking position referring to FIG. 1A, the blocking part 111 of the blocking plate 110 protrudes from the surface 131, thereby providing supporting along the positive or negative X-axis direction. When an external force is applied towards the negative Z-axis direction, the blocking plate 110 is pressed towards inside the recession 132 to the closing position, referring to FIG. 1B, the blocking part 111 may be partially or completely contained in the recession 132. In this embodiment, the blocking plate 110 and the bump 190 are integrated into one piece. In other words, the blocking plate 110 and the bump 190 may not be separated from each other. The blocking plate 110 and the base 130 are formed of foamed polymer. In this embodiment, the blocking element 10 may be cut through along the positive-negative X-axis direction into the shape which is shown in FIGS. 1A and 1B.

Figure 1C:
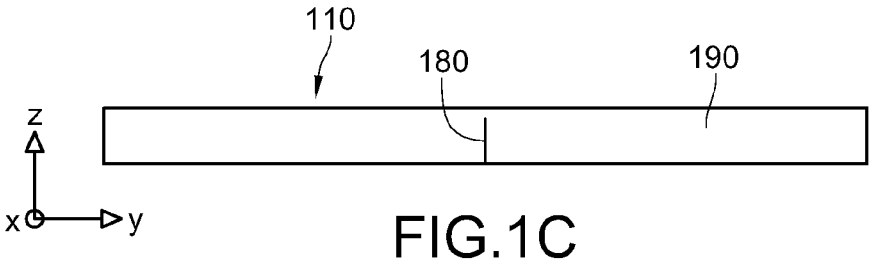
FIGS. 1C and 1D depict cross-sectional views of the blocking element in FIG. 1A in a manufacturing process.
Figure 1D:
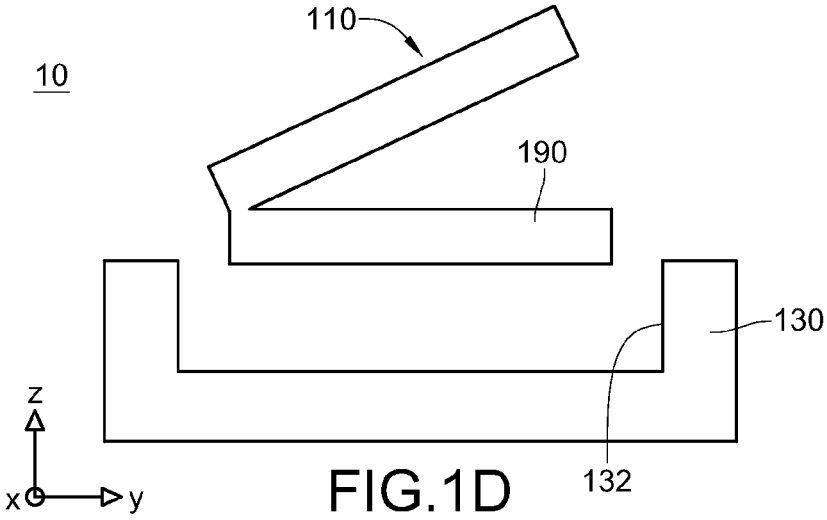

Please refer to FIGS. 1C and 1D, which both depict cross-sectional views of the blocking element in FIG. 1A in a manufacturing process. As shown in FIG. 1C, a cutting line 180 is applied on the surface of a plate facing the negative Z-Axis direction and the plate is not completely cut off by the cutting line 180. The cutting line 180 separates the blocking plate 110 from the bump 190. Moreover, the blocking plate 110 is bent clockwise. As shown in FIG. 1D, after disposing the bump 190 in the recession 132 of the base 130, the arrangement of the blocking element 10 is complete. In this embodiment, the bump 190 may be adhered in the recession 132 for preventing the bump 190 from moving in relative to the base 130.

Figure 2A:
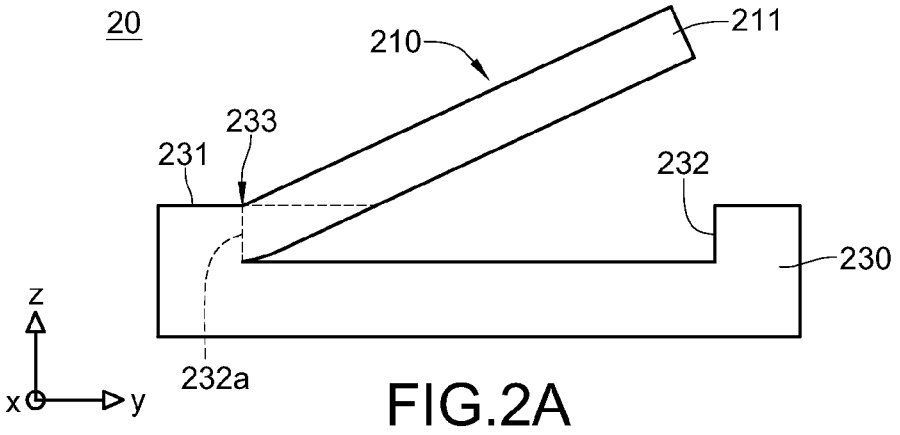
FIG. 2A depicts a cross-sectional view of a blocking element at a blocking position according to another embodiment of the disclosure.
Figure 2B:
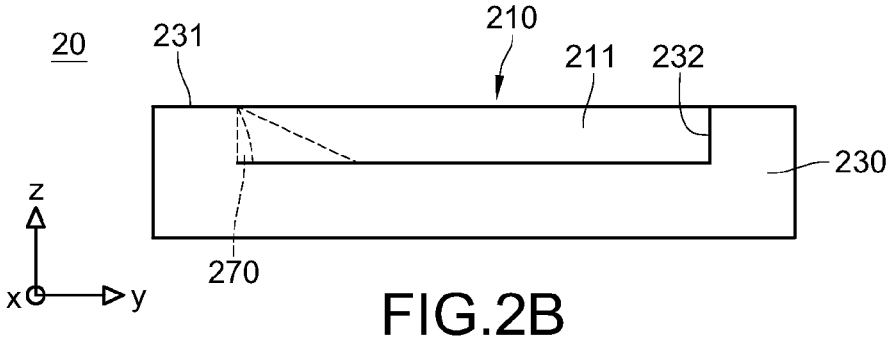
FIG. 2B depicts a cross-sectional view of the blocking element in FIG. 2A at a closing position.

Please refer to FIGS. 2A and 2B, FIG. 2A depicts a cross-sectional view of a blocking element at a blocking position according to another embodiment of the disclosure, and FIG. 2B depicts a cross-sectional view of the blocking element in FIG. 2A at a closing position. A blocking element 20 comprises a base 230 and a blocking plate 210. The base 230 includes a surface 231 and a recession 232. The recession 232 is formed downwardly towards the surface 231. The blocking plate 210 is connected to a cross-connect part 233 of a sidewall 232*a* of the recession 232. The blocking plate 210 is used for pivoting on the cross-connect part 233 and includes a blocking position and a closing position in relative to the cross-connect part 233. In this embodiment, the blocking plate 210 and the base 230 are integrated into one piece and may not be separated from each other. The blocking plate 210 and the base 230 are made of foamed polymer. In this embodiment, the recession 232 does not penetrate through the base 230, but not limited to the embodiment. In some embodiments, the recession may penetrate through the base completely.

When the blocking plate 210 is at the blocking position as shown in FIG. 2A, a blocking part 211 of the blocking plate 210 protrudes from the surface 231, thereby providing supporting along the positive or negative X-axis direction. When an external force is applied in the negative Z-axis direction, the blocking plate 210 is pressed towards the recession 232 to the closing position, as shown in FIG. 2B, and the blocking part 211 may be partially or completely contained in the recession 232. Because the blocking plate 210 and the base 230 are both made of foamed polymer, the intersection of the blocking plate 210 and the base 230 includes a pressing area 270. At this moment, the pressing area 270 made of foamed polymer is pressed by the external force so that the density of the pressing area 270 is greater than that of the blocking plate 210 and that of the base 230. In this embodiment, the blocking element 20 is directly made into the shape by molding, which is shown in FIG. 2A.

Figure 3A:
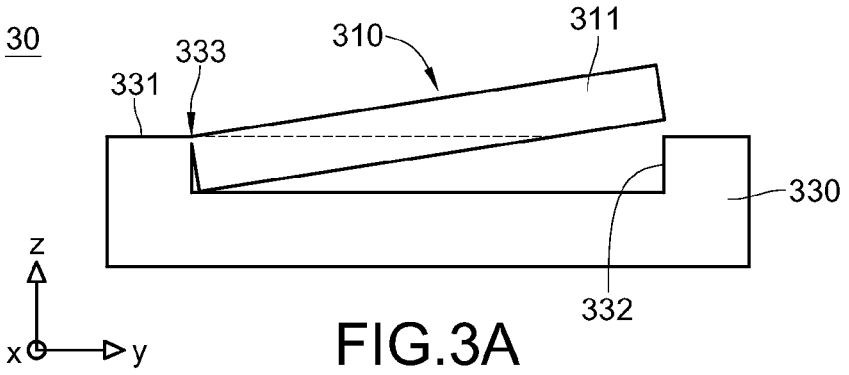
FIG. 3A depicts a cross-sectional view of a blocking element at a blocking position according to yet another embodiment of the disclosure.
Figure 3B:
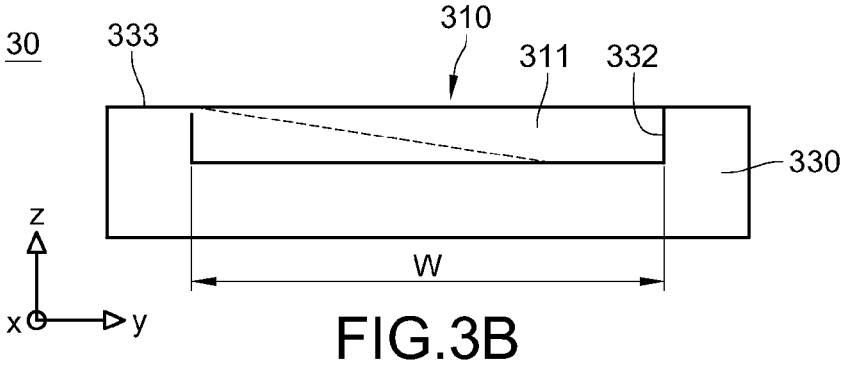
FIG. 3B depicts a cross-sectional view of the blocking element in FIG. 3A at a closing position.

Please refer to FIGS. 3A and 3B, FIG. 3A depicts a cross-sectional view of a blocking element at a blocking position according to yet another embodiment of the disclosure, and FIG. 3B depicts a cross-sectional view of the blocking element in FIG. 3A at a closing position. A blocking element 30 comprises a base 330 and a blocking plate 310. The base 330 includes a surface 331 and a recession 332. The recession 332 is formed downwardly towards the surface 331. The blocking plate 310 is connected to a cross-connect part 333 of the recession 332. The cross-connect part 333 is positioned on the intersection of the recession 332 and the surface 331. The blocking plate 310 is used for pivoting on the cross-connect part 333 and includes a blocking position and a closing position in relative to the cross-connect part 333. In this embodiment, the blocking plate 310 and the base 330 are integrated into one piece and may not be separated from each other. The blocking plate 310 and the base 330 are made of foamed polymer.

When the blocking plate 310 is at the blocking position shown in FIG. 3A, a blocking part 311 of the blocking plate 310 protrudes from the surface 331, thereby providing supporting along the positive or negative X-axis direction. When an external force is applied towards the negative Z-axis direction, the blocking plate 310 is pressed towards the recession 332 to the closing positioning as shown FIG. 3B, and the blocking part 311 may be partially or completely contained in the recession 332. In this embodiment, the shape of the blocking element 30 may be obtained by cutting the blocking element 30 along the X-Axis as shown in FIG. 3B. In this embodiment, the shape and the size of the blocking plate 310 substantially corresponds to those of the recession 332. After the blocking element 30 is cut referring to FIG. 3B, the blocking plate 310 is pulled away from the recession 332. In this embodiment, the distance of the diagonal line of the blocking plate 310 is greater than the width W of the recession 332. However, because of the microdeformation of the foamed polymer, the blocking plate 310 may be pulled away from the recession 332, so that the blocking plate 310 is moved to the blocking position in FIG. 3A. Besides, the distance of the diagonal line of the blocking plate 310 is greater than the width W of the recession 332 and the foamed polymer may be deformed slightly, so a user must apply an external force along the negative Z-axis direction, the blocking plate 310 may be pressed to the closing positioning as shown in FIG. 3B.

Please refer to 4A, which depicts a cross-sectional view of a blocking element at a blocking position according to yet another embodiment of the disclosure. The structure of a blocking element 40 in this embodiment is similar to the blocking element 30 in FIGS. 3A and 3B. However, in the blocking element 40, a base 430 includes a first layer 434 and a second layer 435. The first layer 434 and the second layer 435 are stacked with each other. The recession 432 includes a sidewall 432*a* and a bottom part 432*b*. The first layer 434 forms the sidewall 432*a*, the second layer 435 forms the bottom part 432*b*, and the first layer 434 and the second layer 435 are partially separated from each other.

Figure 4A:
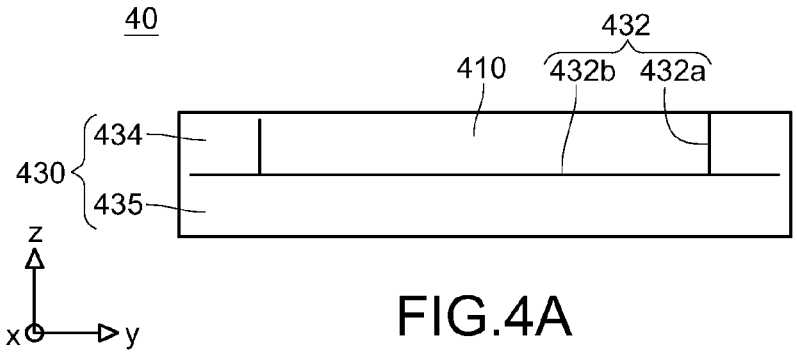
FIG. 4A depicts a cross-sectional view of a blocking element at a blocking position according to yet another embodiment of the disclosure.
Figure 4B:
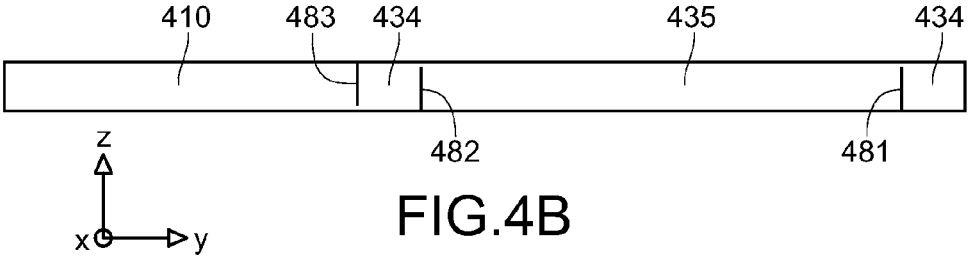
FIG. 4B depicts a cross-sectional view of the blocking element in FIG. 4A at a closing position.

Please refer to FIG. 4B, which depicts a cross-sectional view of the blocking element in FIG. 4A at a closing position. Two cutting lines 481, 482 are applied on the surface of a plate facing the negative Z-Axis direction and not completely cut off. Moreover, another cutting line 483 is applied on the surface of the plate facing the negative Z-Axis direction and is not completely cut off. In other words, the plate is divided into the first layer 434, the second layer 435, another first layer 434 and a blocking plate 410 according to the above-mentioned cutting lines 481, 482, 483. Afterwards, the first layer 434 is bent towards the positive Z-Axis direction of the second layer 435 so that the blocking plate 410 and the first layer 434 are positioned on the positive Z-Axis direction of the second layer 435. The blocking plate 410 may be pulled away from the second layer 435 through the cutting line 483.

Figure 4C:
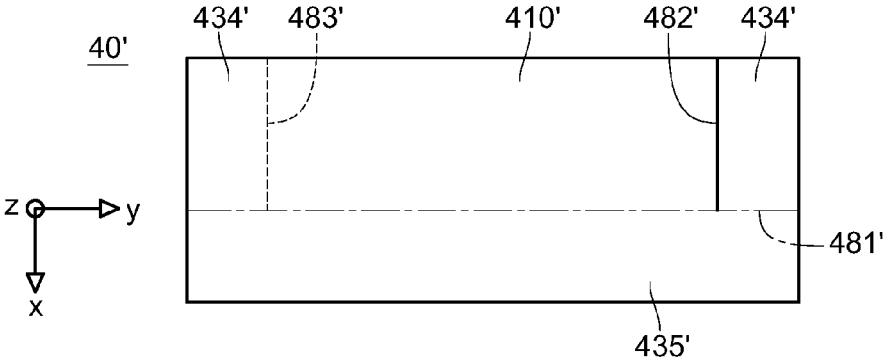
FIG. 4C depicts a top view of the blocking element according to yet another embodiment of the disclosure in a manufacturing process.

Please refer to FIG. 4C, which depicts a top view of the blocking element according to yet another embodiment of the disclosure in a manufacturing process. The solid line of the cutting line represents the line which is completely cut off; the dashed line of the cutting line represents the cutting line which may not be observed from this view, but the cutting line on the rear side, which may not be observed from this view, may not be cut off completely; and the long-dashed-short-dashed line represents the cutting line which is not completely cut off on the observed side. In this embodiment, the structure of a blocking element 40' is similar to that of the blocking element 40 in FIGS. 4A and 4B. The difference is that the separation position of a first layer 434' and a second layer 435' is different from that of the first layer 434 and the second layer 435. A cutting line 481' which is not completely cut off is applied on the surface of a plate facing the positive Z-Axis direction to separate the second layer 435'. Moreover, a cutting line 482' cut off completely and a cutting line 483' incompletely cut off are applied on the surface of the plane facing the positive Z-Axis direction. In other words, the plate is divided into the first layer 434', a blocking plate 410' and another first layer 434' through the above-mentioned cutting lines 482', 483'. After that, the second layer 435' is bent towards the negative Z-Axis direction of the first layer 434', the blocking plate 410' and the another first layer 434'. The blocking plate 410' may be pulled away from the second layer 435' through the cutting line 483'.

Figure 4D:
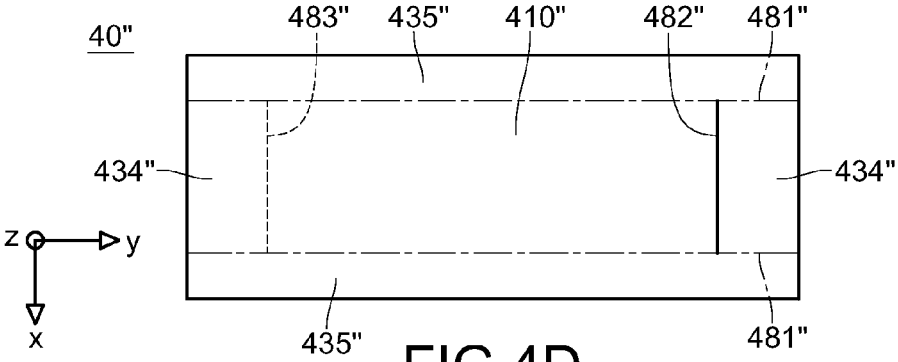
FIG. 4D depicts a top view of the blocking element according to yet another embodiment of the disclosure in a manufacturing process.

Please refer to FIG. 4D, which depicts a top view of the blocking element according to yet another embodiment of the disclosure in a manufacturing process. The solid line of the cutting line represents the line which is completely cut off; the dashed line of the cutting line represents the cutting line which may not be observed from this view, but the cutting line on the rear side, which may not be observed from this view, may not be cut off completely; and the long-dashed-short-dashed line represents the cutting line which is not completely cut off on the observed side. The structure of a blocking element 40" in this embodiment is similar to that of the blocking element 40' in FIG. 4C, except that a second layer 435" is divided into multiple pieces (the multiple second layers 435"). Two cutting lines 481" are applied on the surface of a plate facing the positive Z-Axis direction and not completely cut off to separate the two second layers 435". Moreover, between the two cutting lines 481", a cutting line 482" cut off completely and a cutting line 483" cut off incompletely are applied on the surface of the plate facing the positive Z-Axis direction. The plate which is between the two cutting lines 481" is divided into a first layer 434", a blocking plate 410" and another first layer 434" according to the above-mentioned cutting lines 482", 483". After that, the second layer 435" is bent towards the negative Z-axis direction of the first layer 434", the blocking plate 410" and the first layer 434". The blocking plate 410" is pulled away from the second layer 435" through the cutting line 483".

Figure 5A:
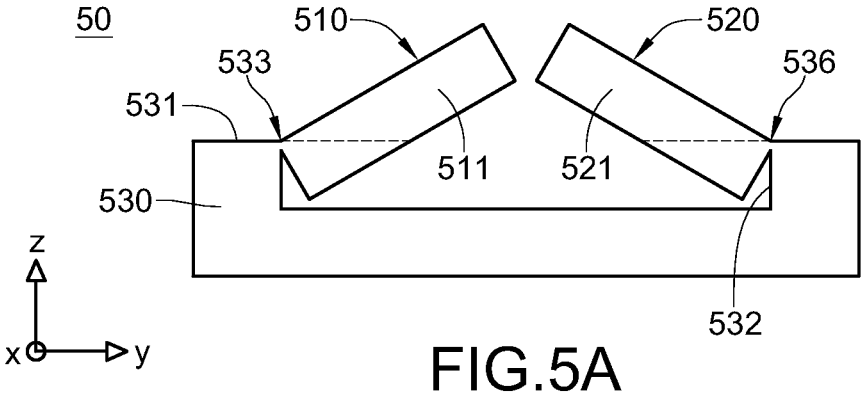
FIG. 5A depicts a cross-sectional view of a blocking element at a first blocking position and a second blocking position according to yet another embodiment of the disclosure.
Figure 5B:
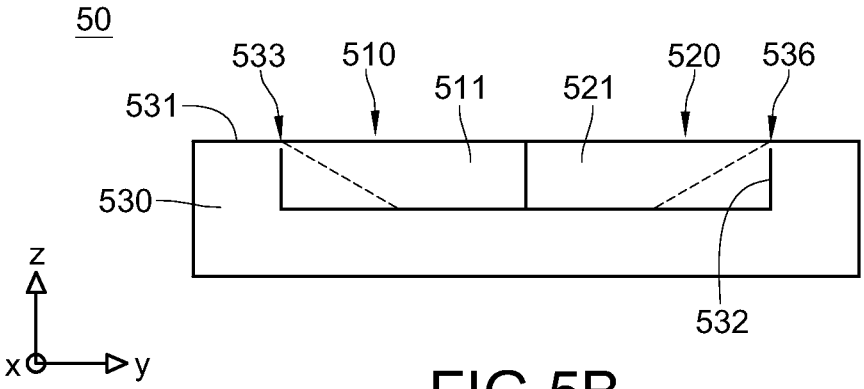
FIG. 5B depicts a cross-sectional view of the blocking element at a first closing position and a second closing position in FIG. 5A.
Figure 5C:
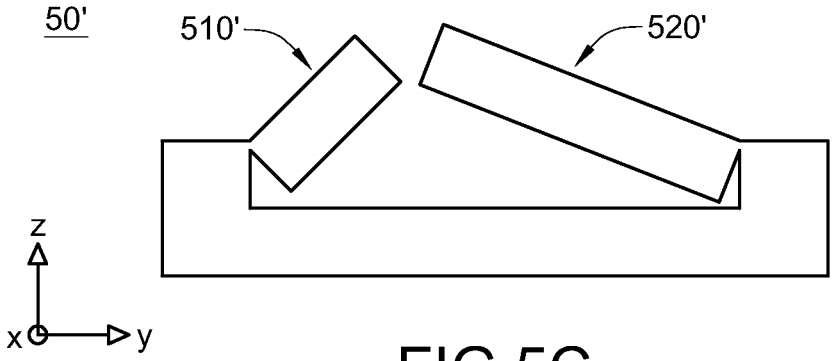
FIG. 5C depicts a cross-sectional view of the blocking element according to yet another embodiment of the disclosure.

Please refer to FIGS. 5A and 5B. FIG. 5A depicts a cross-sectional view of a blocking element at a first blocking position and a second blocking position according to yet another embodiment of the disclosure, and FIG. 5B depicts a cross-sectional view of the blocking element at a first closing position and a second closing position in FIG. 5A. A blocking element 50 comprises a first blocking plate 510, a second blocking plate 520 and a base 530. The base 530 includes a surface 531 and a recession 532. The recession 532 is formed downwardly towards the surface 531. The first blocking plate 510 is connected to a first cross-connect part 533 of the recession 532. The first cross-connect part 533 is positioned on the intersection of the recession 532 and the surface 531. The first blocking plate 510 is used for pivoting on the first cross-connect part 533 and includes a first blocking position and a first closing position in relative to the first cross-connect part 533. The second blocking plate 520 is connected to a second cross-connect part 536 of the recession 532. The second cross-connect part 536 is positioned on the intersection of the recession 532 and the surface 531. The second blocking plate 520 is used for pivoting on the second cross-connect part 536 and includes a second blocking position and a second closing position in relative to the second cross-connect part 536. In this embodiment, the first cross-connect part 533 and the second cross-connect part 536 are positioned on two opposite sides of the recession 532, respectively, but not limited to the disclosure. In some embodiments, the first cross-connect part 533 and the second cross-connect part 536 are positioned on two adjacent sides of the recession 532 (not shown). In this embodiment, the first blocking plate 510 and the base 530 are integrated into one piece and may not be separated from each other. The second blocking plate 520 and the base 530 are integrated into one piece as well. The first blocking plate 510, the second blocking plate 520 and the base 530 are made of foamed polymer. In this embodiment, the shape of the blocking element 50 in FIGS. 5A and 5B may be formed by cutting through in the positive-negative X-Axis direction.

When the first blocking plate 510 is at the first blocking position and the second blocking position in FIG. 5A, a first blocking part 511 of the first blocking plate 510 and a second blocking part 521 of the second blocking plate 520 both protrude from the surface 531, thereby providing supporting in the positive-negative X-Axis direction. When an external force is applied in the negative Z-Axis direction, the first blocking plate 510 and the second blocking plate 520 are pressed towards the recession 532 to the first closing position and the second closing position in FIG. 5B, respectively, and the first blocking part 511 and the second blocking part 521 may be partially or completely contained in the recession 532. In this embodiment, the first blocking plate 510 and the second blocking plate 520 are at the first blocking position and the second blocking position in the mean time, respectively, or at the first closing position and the second closing position in the mean time, respectively. However, in some embodiments, the first blocking plate 510 and the second blocking plate 520 are at the first blocking position and the second closing position in the mean time, respectively, or at the first closing position and the second blocking position in the mean time, respectively.

As shown in FIGS. 5A and 5B, the size of the first blocking plate 510 is the same as that of the second blocking plate 520, but not limited to the disclosure. Please refer to 5C, which depicts a cross-sectional view of the blocking element according to yet another embodiment of the disclosure, the size of a first blocking plate 510' of the blocking element 50' is different from that of a second blocking plate 520' of the blocking element 50'.

Figure 6A:
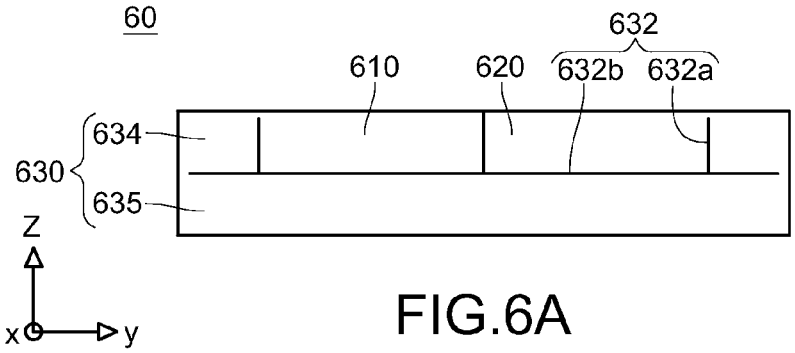
FIG. 6A depicts a cross-sectional view of a blocking element at a first closing position and a second closing position according to yet another embodiment of the disclosure.

Please refer to FIG. 6A, which depicts a cross-sectional view of a blocking element at a first closing position and a second closing position according to other embodiment of the disclosure. The structure of a blocking element 60 in this embodiment is similar to that of the blocking element 50 in FIGS. 5A and 5B. However, in the blocking element 60, a base 630 comprises a first layer 634 and a second layer 635. The first layer 634 and the second layer 635 are stacked with each other. A recession 632 includes a sidewall 632*a* and a bottom part 632*b*. The first layer 634 forms the sidewall 632*a*, the second layer 635 forms the bottom part 632*b*, and the first layer 634 and the second layer 635 are partially separated.

Please refer to 6B, which depicts a cross-sectional view of the blocking element in FIG. 6A in a manufacturing process. Two cutting lines 681, 682 are applied on the surface of a plate facing the negative Z-Axis direction. Moreover, the two cutting lines 683, 684 are applied on another surface of the plate facing the positive Z-Axis direction. In other words, the plate is divided into a second blocking plate 620, the first layer 634, the second layer 635, another first layer 634 and the first blocking plate 610 according to the cutting lines 684, 681, 682, 683. After that, the first layer 634 is bent towards the positive Z-Axis direction of the second layer 635 so that the first blocking plate 610, the first layers 634 and the second blocking plate 620 is positioned on the positive Z-Axis of the second layer 635. The first blocking plate 610 and the second blocking plate 620 are pulled away from the second layer 635 through the cutting lines 683, 684, respectively.

Figure 6B:
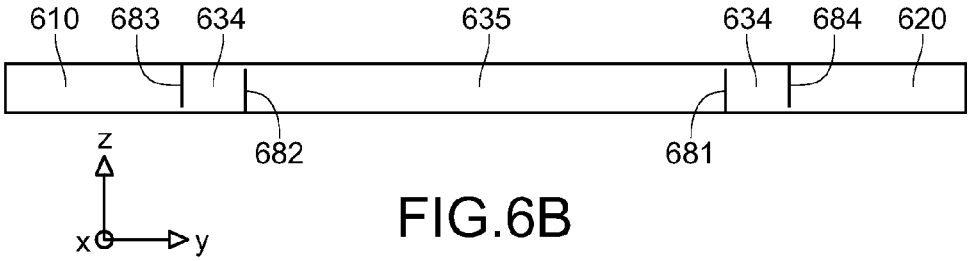
FIG. 6B depicts a cross-sectional view of the blocking element in FIG. 6A in a manufacturing process.
Figure 6C:
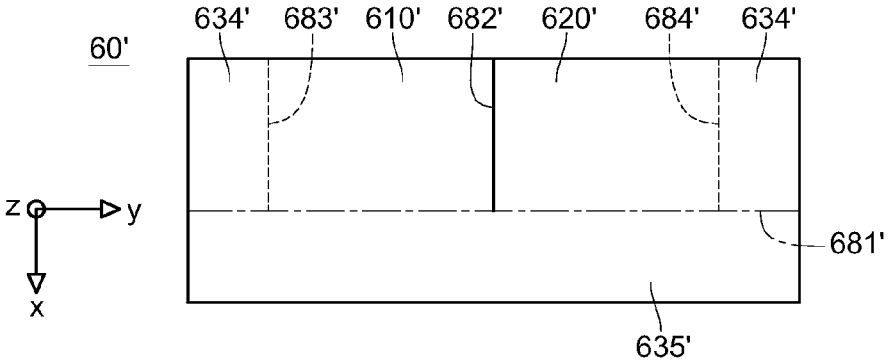
FIG. 6C depicts a top view of the blocking element in a manufacturing process according to other embodiment.

Please refer to FIG. 6C, which depicts a top view of the blocking element in a manufacturing process according to yet another embodiment. The solid line of the cutting line represents the line which is completely cut off; the dashed line of the cutting line represents the cutting line which may not be observed from this view, but the cutting line on the rear side, which may not be observed from this view, may not be cut off completely; and the long-dashed-short-dashed line represents the cutting line which is not completely cut off on the observed side. In this embodiment, the structure of a blocking element 60' is similar to that of the blocking element 60 in FIGS. 6A and 6B. The difference is that the separation position of a first layer 634' and a second layer 635' is different from the separation position of the first layer 634 and the second layer 635. A cutting line 681' is applied on the surface of a plate facing the positive Z-axis direction and is cut incompletely to separate the second layer 635'. Furthermore, a cutting line 682' cut completely and two cutting lines 683', 684' cut incompletely are applied on another surface of the plate facing the positive Z-Axis direction. In other words, the plate is divided into the first layer 634', a second blocking plate 620', a first blocking plate 610' and another first layer 634' according to the cutting line 684', 682', 683'. Afterwards, the second layer 635' is bent towards the negative Z-Axis direction of the first layer 634', the second blocking plate 620', the first blocking plate 610' and the first layer 634'. The first blocking plate 610' and the second blocking plate 620' may be pulled away from the second layer 635' through the cutting lines 683', 684'.

Figure 6D:
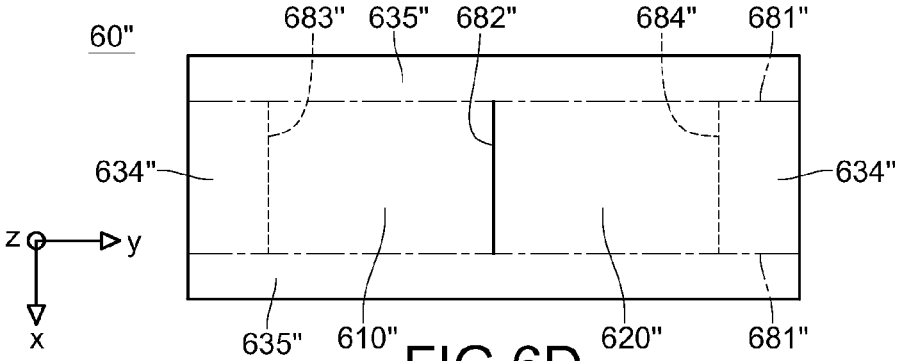
FIG. 6D depicts a top view of the blocking element in a manufacturing process according to yet another embodiment.

Please refer to FIG. 6D, which depicts a top view of the blocking element in a manufacturing process according to other embodiment. The solid line of the cutting line represents the line which is completely cut off; the dashed line of the cutting line represents the cutting line which may not be observed from this view, but the cutting line on the rear side, which may not be observed from this view, may not be cut off completely; and the long-dashed-short-dashed line represents the cutting line which is not completely cut off on the observed side. In this embodiment, the structure of a blocking element 60" is similar to that of the blocking element 60' in FIG. 6C. The difference is that a second layer 635" is divided into multiple pieces (the multiple second layers 635"). Two cutting lines 681" are applied on the surface of a plate facing the positive Z-Axis direction and are not completely cut off to separate the two second layer 635" from the blocking element 60". Moreover, between the two cutting lines 681", a cutting line 682" cut off completely and two cutting lines 683", 684" cut off incompletely are applied on the surface of the plate facing the positive Z-Axis direction. In other words, the plate is divided into a first layer 634", a second blocking plate 620", a first blocking plate 610" and another first layer 634" according to the cutting lines 684", 682", 683". The second layer 635" is bent to the negative Z-Axis direction of the first layer 634", the second blocking plate 620", the first blocking plate 610" and another first layer 634". The first blocking plate 610" and the second blocking plate 620" may be pulled away from the second layer 635' through the cutting lines 683', 684'.

Figure 7A:
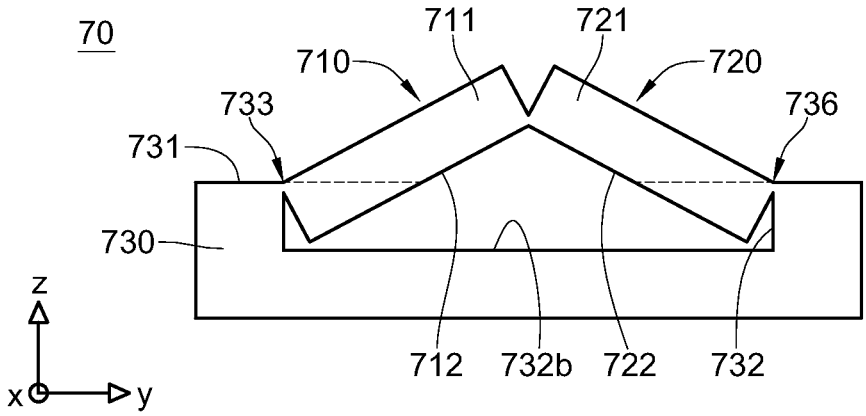
FIG. 7A depicts a cross-sectional view of a blocking element at a blocking position according to yet another embodiment of the disclosure.
Figure 7B:
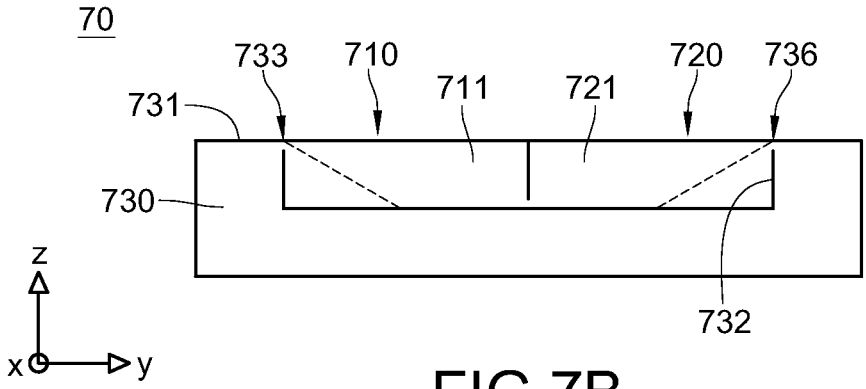
FIG. 7B depicts a cross-sectional view of the blocking element in FIG. 7A in a manufacturing process.

Please refer to FIGS. 7A and 7B. FIG. 7A depicts a cross-sectional view of a blocking element at a blocking position according to yet another embodiment of the disclosure. FIG. 7B depicts a cross-sectional view of the blocking element in FIG. 7A in a manufacturing process. A blocking element 70 comprises a first blocking plate 710, a second blocking plate 720 and a base 730. The base 730 includes a surface 731 and a recession 732 formed downwardly towards the surface 731. The first blocking plate 710 is connected to a first cross-connect part 733 of the recession 732. The first cross-connect part 733 is positioned on the intersection of the recession 732 and the surface 731. The first blocking plate 710 is used for pivoting on the first cross-connect part 733 and includes a blocking position and a closing position in relative to the first cross-connect part 733. The second blocking plate 720 is connected to a second cross-connect part 736 of the recession 732. The second cross-connect part 736 is positioned on the intersection of the recession 732 and the surface 731. The second blocking plate 720 is used for pivoting on the second cross-connect part 736 and includes a blocking position and a closing position in relative to the second cross-connect part 736.

In this embodiment, the first cross-connect part 733 and the second cross-connect part 736 is positioned on two opposite sides of the recession 732, respectively. The first blocking plate 710 and the base 730 are integrated into one piece and may not be separated from each other. The second blocking plate 720 and the base 730 are integrated into one piece as well. The first blocking plate 710, the second blocking plate 720 and the base 730 are made of foamed polymer. In this embodiment, the size of the first blocking plate 710 is the same as that of the second blocking plate 720, but not limited to the embodiment. In some embodiments, the size of the first blocking plate is different from the size of the second blocking plate as well. In this embodiment, the shape of the blocking element 70 may be obtained by cutting the blocking element 70 along the positive-negative X-Axis direction as shown in FIGS. 7A and 7B.

When the first blocking plate 710 is at the blocking position in FIG. 7A, a first blocking part 711 of the first blocking plate 710 and a second blocking part 721 of the second blocking plate 720 both protrude from the surface 731, thereby providing supporting in the positive-negative X-Axis direction. When an external force is applied in the negative Z-Axis direction, the first blocking plate 710 and the second blocking plate 720 are both pressed towards the recession 732 to the closing position shown in FIG. 7B, and the first blocking part 711 and the second blocking part 721 may be partially or completely contained in the recession 732. In this embodiment, the recession 732 includes a bottom part 732*b*. The first blocking plate 710 includes a first bottom surface 712 facing the bottom part 732*b*. The second blocking plate 720 includes a second bottom surface 722 facing the bottom part 732*b*. The first bottom surface 712 and the second bottom surface 722 are connected to each other. Therefore, when the first blocking plate 710 is at the blocking position, the second blocking plate 720 which is related to the first blocking plate 710 is pulled to the blocking position.

Figure 8A:
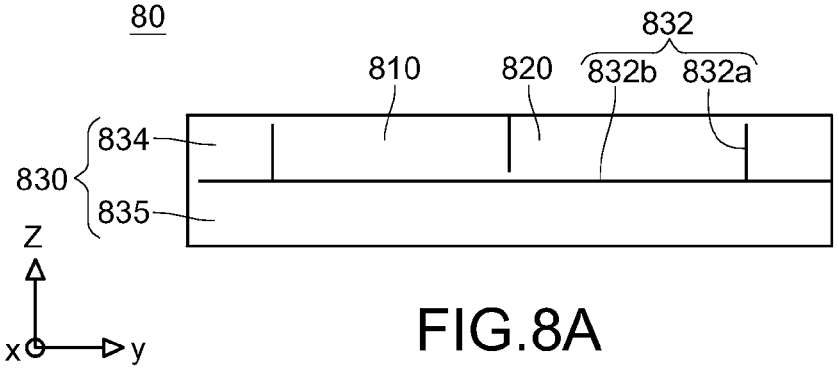
FIG. 8A depicts a cross-sectional view of a blocking element at a closing position according to yet another embodiment of the disclosure.

Please refer to FIG. 8A, which depicts a cross-sectional view of a blocking element at a closing position according to yet another embodiment of the disclosure. The structure of a blocking element 80 is similar to that of the blocking element 70 in FIGS. 7A and 7B. However, in the blocking element 80, a base 830 includes a first layer 834 and a second layer 835. The first layer 834 and the second layer 835 are stacked with each other. A recession 832 includes a sidewall 832*a* and a bottom part 832*b*. The first layer 834 forms the sidewall 832*a*, the second layer 835 forms the bottom part 832*b*, and the first layer 834 and the second layer 835 are partially separated.

Figure 8B:
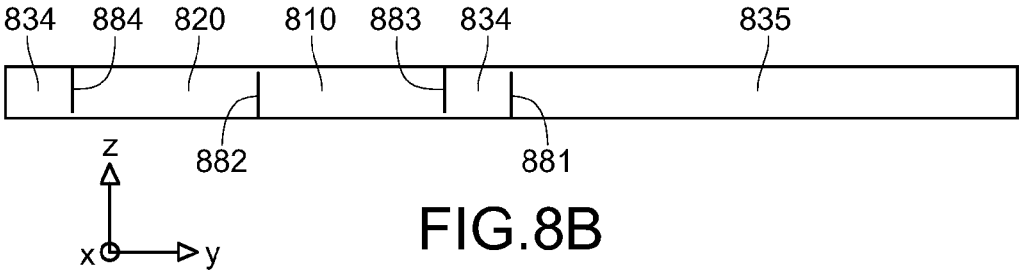
FIG. 8B depicts a cross-sectional view of the blocking element in FIG. 8A in a manufacturing process.

Please refer to FIG. 8B, which depicts a cross-sectional view of the blocking element in FIG. 8A in a manufacturing process. Two cutting lines 881, 882 cut incompletely are applied on the surface of a plate facing the negative Z-Axis direction. Furthermore, two cutting lines 883, 884 cut incompletely are applied on another surface of the plate facing the positive Z-Axis direction. In other words, the plate is divided into the second layer 835, the first layer 834, the first blocking plate 810, the second blocking plate 820 and another first layer 834 according to the cutting lines 881, 883, 882, 884. After that, the first layer 834 is bent upwardly towards the positive Z-Axis direction of the second layer 835 to make the first layers 834, the first blocking plate 810 and the second blocking plate 820 being positioned on the positive Z-Axis direction of the second layer 835. The first blocking plate 810 and the second blocking plate 820 are pulled away from the second layer 835 through the cutting lines 883, 884.

Figure 8C:
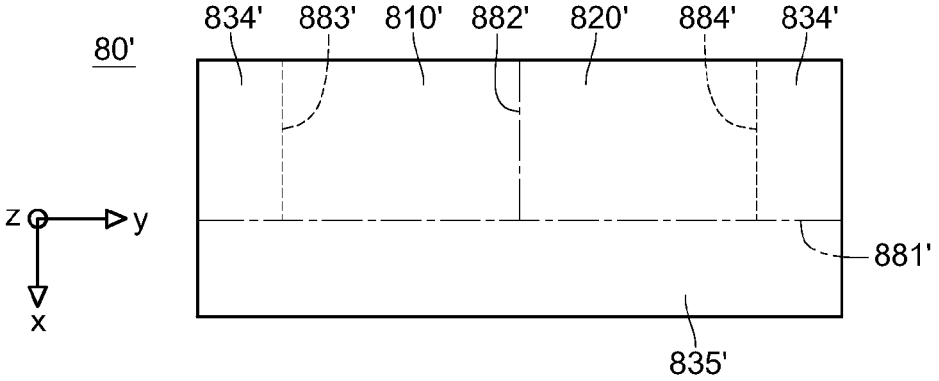
FIG. 8C depicts a top view of the blocking element in a manufacturing process according to yet another embodiment.

Please refer to FIG. 8C, which depicts a top view of the blocking element in a manufacturing process according to yet another embodiment. The solid line of the cutting line represents the line which is completely cut off; the dashed line of the cutting line represents the cutting line which may not be observed from this view, but the cutting line on the rear side, which may not be observed from this view, may not be cut off completely; and the long-dashed-short-dashed line represents the cutting line which is not completely cut off on the observed side. In this embodiment, the structure of a blocking element 80' is similar to that of the blocking element 80 in FIGS. 8A and 8B. The main difference is that the separation position of a first layer 834' and a second layer 835' is different from the separation position of the first layer 834 and the second layer 835. A cutting line 881' cut incompletely is applied on the surface of a plane facing the positive Z-Axis direction to separate the second layer 835'. Moreover a cutting line 882' cut incompletely and two cutting lines 883', 884' cut incompletely are applied on the surface of the plane facing the positive Z-Axis direction. The plate is divided into the first layer 834', the second blocking plate 820', the first blocking plate 810' and another first layer 834' according to the cutting lines 884', 882', 883'. After that, the second layer 835' is bent towards the negative Z-Axis direction of the first layer 834', a second blocking plate 820', the first blocking plate 810' and another first layer 834'. The first blocking plate 810' and the second blocking plate 820' may be pulled away from the second layer 835' through the cutting lines 883', 884'.

Figure 8D:
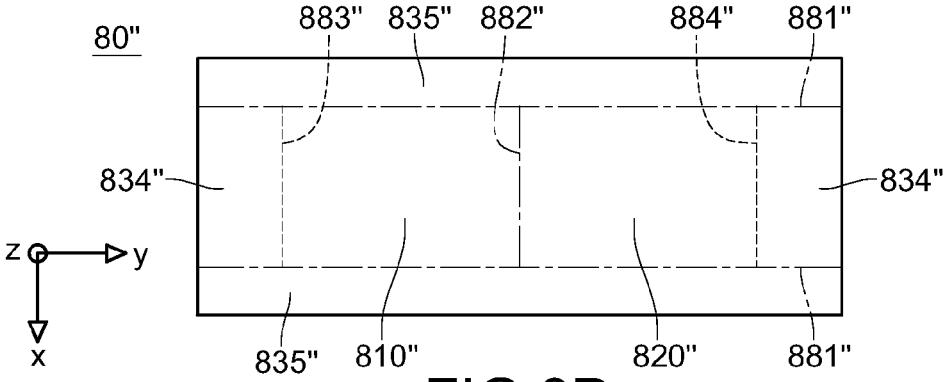
FIG. 8D depicts a top view of the blocking element in a manufacturing process according to yet another embodiment.

Please refer to FIG. 8D, which depicts a top view of the blocking element in a manufacturing process according to yet another embodiment. The solid line of the cutting line represents the line which is completely cut off; the dashed line of the cutting line represents the cutting line which may not be observed from this view, but the cutting line on the rear side, which may not be observed from this view, may not be cut off completely; and the long-dashed-short-dashed line represents the cutting line which is not completely cut off on the observed side. In this embodiment, the structure of a blocking element 80" in this embodiment is similar to that of the blocking element 80' in FIG. 8C. The main difference is that a second layer 835" is divided into multiple pieces (the multiple second layers 835"). Two cutting lines 881" cut incompletely are applied on the surface of a plate facing the positive Z-Axis direction to separate the two second layer 835". Moreover, between the two cutting lines 881", a cutting line 882" cut incompletely and two cutting lines 883", 884" cut incompletely are applied on the surface of the plate facing the positive Z-Axis direction. The plate is divided into the first layer 834", the second blocking plate 820", the first blocking plate 810" and another first layer 834" according to the cutting lines 884", 882", 883". After that, the second layers 835" are bent to the negative Z-Axis direction of the first layer 834", a second blocking plate 820", the first blocking plate 810" and another first layer 834". The first blocking plate 810" and the second blocking plate 820" may be pulled away from the second layer 835' through the cutting lines 883', 884'.

Figure 9A:
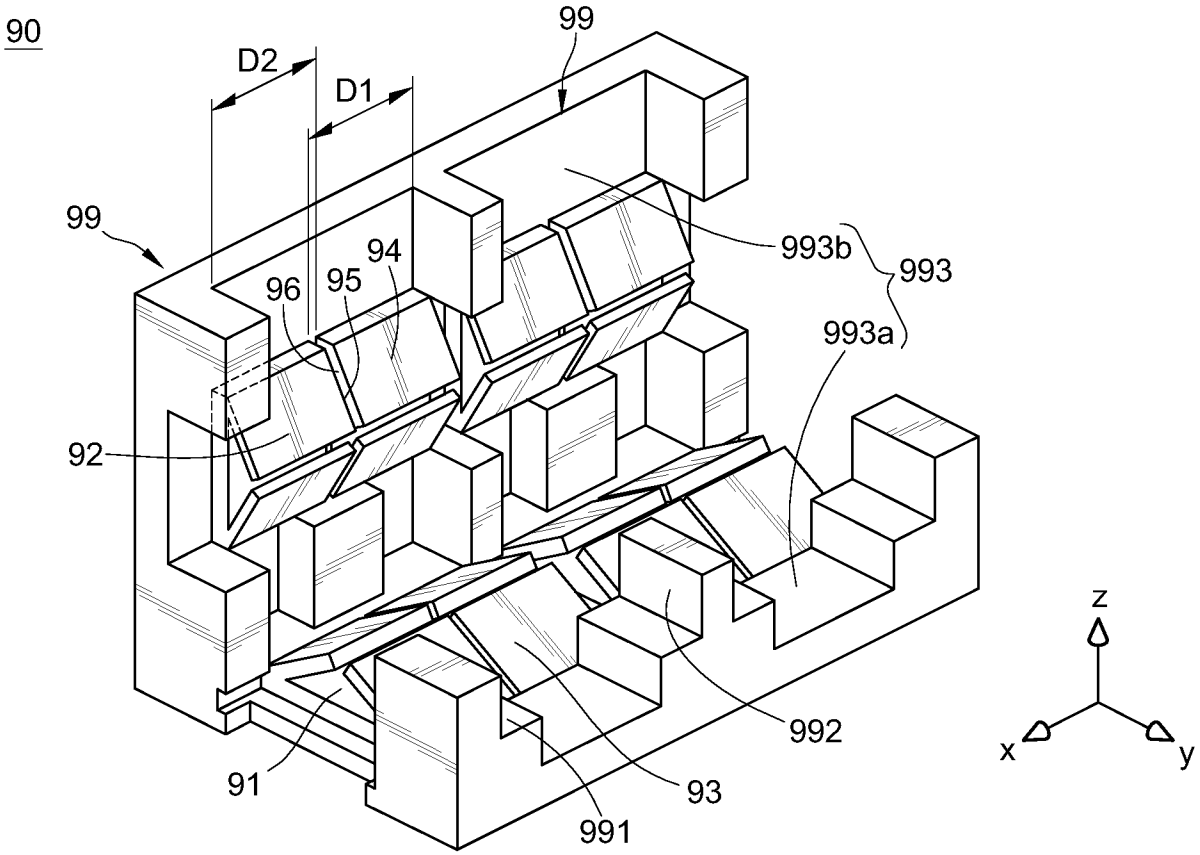
FIG. 9A depicts a perspective view of a protective structure according to an embodiment of the disclosure.

Please refer to FIG. 9A, which depicts a perspective view of a protective structure according to an embodiment of the disclosure. A protective structure 90 comprises multiple containers 99. Each of the containers 99 includes a bottom surface 993, a first lateral surface 991 and a second lateral surface 992. A first blocking element 91, a second blocking element 92, a third blocking element 93 and a fourth blocking element 94 are all disposed in each of the containers 99. The shape of the containers 99 are L shape. The bottom surface 993 includes an L-shaped level part 993*a* and an L-shaped standing part 993*b*. The first blocking element 91 and the third blocking element 93 are disposed on the L-shaped level part 993*a*. The second blocking element 92 and the fourth blocking element 94 are disposed on the L-shaped standing part 993*b*. The first blocking element 91 and the second blocking element 92 include an edge 95 in the vicinity of the second lateral surface 992, respectively. The edges 95 both keep a distance D1 from the second lateral surface 992. A first workpiece may be contained between the edges 95 and the second lateral surface 992. In other words, the length of the first workpiece is equal to or less than the distance D1. In this embodiment, the first workpiece may be a display panel, nut not limited to the disclosure. The third blocking element 93 and the fourth blocking element 94 include an edge 96 in the vicinity of the first lateral surface 991, respectively. The edges 96 keep another distance D2 from the first lateral surface 991. A second workpiece may be contained between the edges 96 and the first lateral surface 991. In other words, the length of the second workpiece is equal to or less than the distance D2. Besides, the length of the distances D1, D2 may be different from each other, so the thickness of the first workpiece may be different from that of the second workpiece. The first blocking element 91, the second blocking element 92, the third blocking element 93 and the fourth blocking element 94 may be selected from the group consisting of the blocking elements in FIGS. 1A to 8D and a combination thereof. In the embodiment shown in FIGS. 9A and 9B, the first blocking element 91, the second blocking element 92, the third blocking element 93 and the fourth blocking element 94 may be made of the single or multiple blocking element 20 shown in FIG. 2A, but not limited to the disclosure. The bottom surface 993 may become a surface of a base of the first blocking element 91, the second blocking element 92, the third blocking element 93 and the fourth blocking element 94.

Figure 9B:
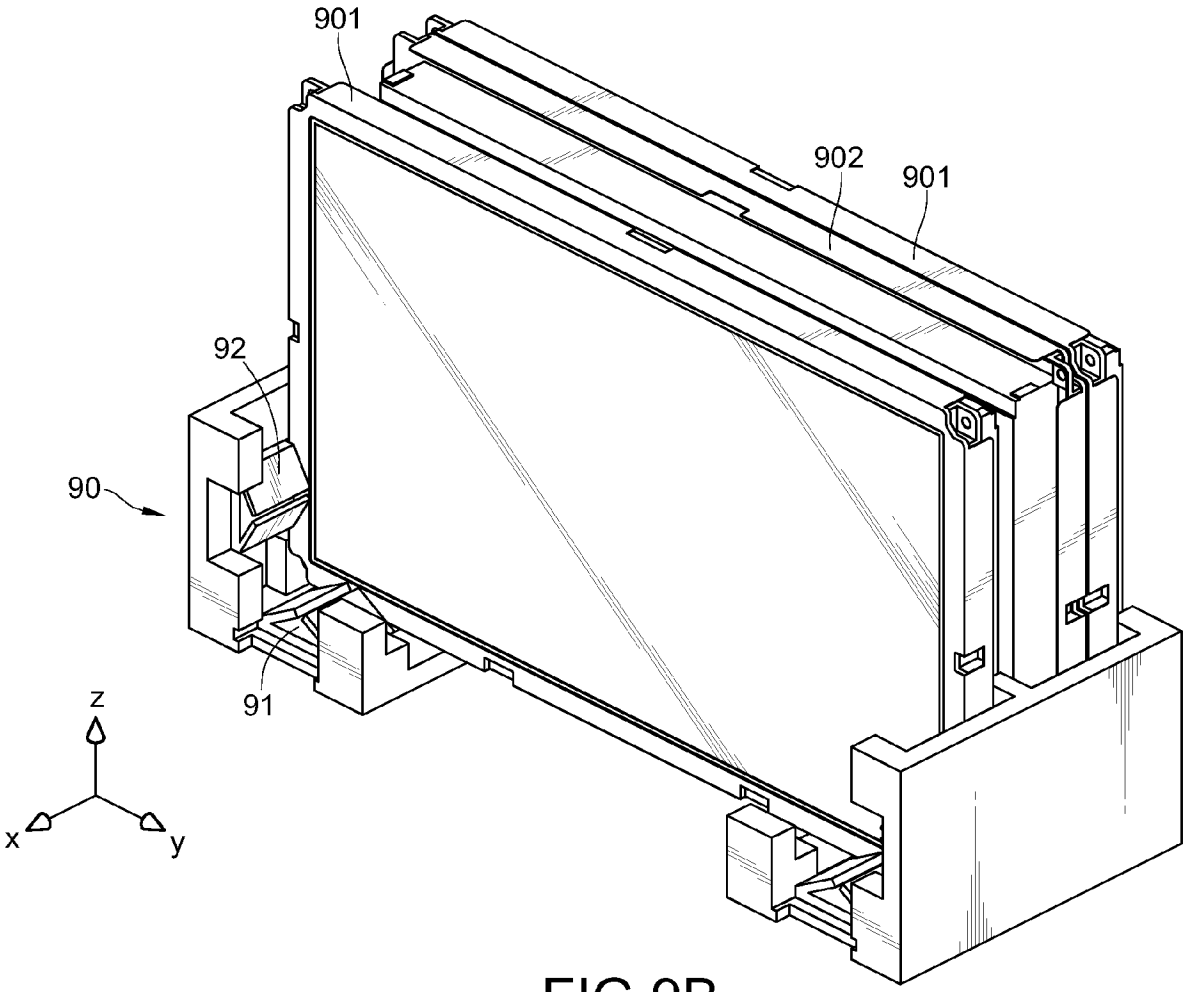
FIG. 9B depicts an exemplary perspective view of using the protective structure in FIG. 9A.

Please refer to FIGS. 9A and 9B. FIG. 9B depicts an exemplary perspective view of using the protective structure in FIG. 9A. The first blocking element 91, the second blocking element 92, the third blocking element 93 and the fourth blocking element 94 are disposed at a blocking position before a first workpiece 901 and a second workpiece 902 is disposed. When the first workpiece 901 is disposed, the third blocking element 93 and the fourth blocking element 94 are pressed to a closing position by the first workpiece 901. At the moment, the first blocking element 91 and the second blocking element 92 may be maintained at the blocking position to provide supporting in X-Axis direction for the first workpiece 901. The first workpiece 901 may not be collapsed because of the support provided by the first blocking element 91 and the second blocking element 92. After that, when the second workpiece 902 is disposed on the same container 99 in which the first workpiece 901 has disposed, the first workpiece 901 does not interfere with the disposing of the second workpiece 902 because of the support provided by the first blocking element 91 and the second blocking element 92. Furthermore, in other embodiments, only the first blocking element 91 and the second blocking element 92 are disposed in the container 99 without disposing the third blocking element 93 and the fourth blocking element 94. In this embodiment, when disposing the first workpiece 901, only the first workpiece 901 may be disposed between the first blocking element 91 and the second lateral surface 992 as well as between the second blocking element 92 and the second lateral surface 992. The first blocking element 91 and the second blocking element 92 both keep a distance D1 with the second lateral surface 992. In this way, the first blocking element 91 and the second blocking element 92 may still provide the supporting in X-Axis direction for the first workpiece 901.

Therefore, the protective structure 90 of the disclosure enables the single container 99 to contain the multiple workpieces. Moreover, when the workpieces are disposed in the container 99 in sequence, the first workpiece 901 which is disposed earlier may not be collapsed because of the support provided by the first blocking element 91 and the second blocking element 92. Thus, during disposing the second workpiece 902 in the container 99, the first workpiece 901 does not interfere with the second workpiece 902, so the second workpiece 902 may be disposed in the container 99 smoothly. Take both the first workpiece 901 and the second workpiece 902 as a display panel for example, when the first workpiece 901 and the second workpiece 902 are disposed in the container 99, a display screen of the first workpiece 901 and that of the second workpiece 902 may face to face to each other.

Figure 10A:
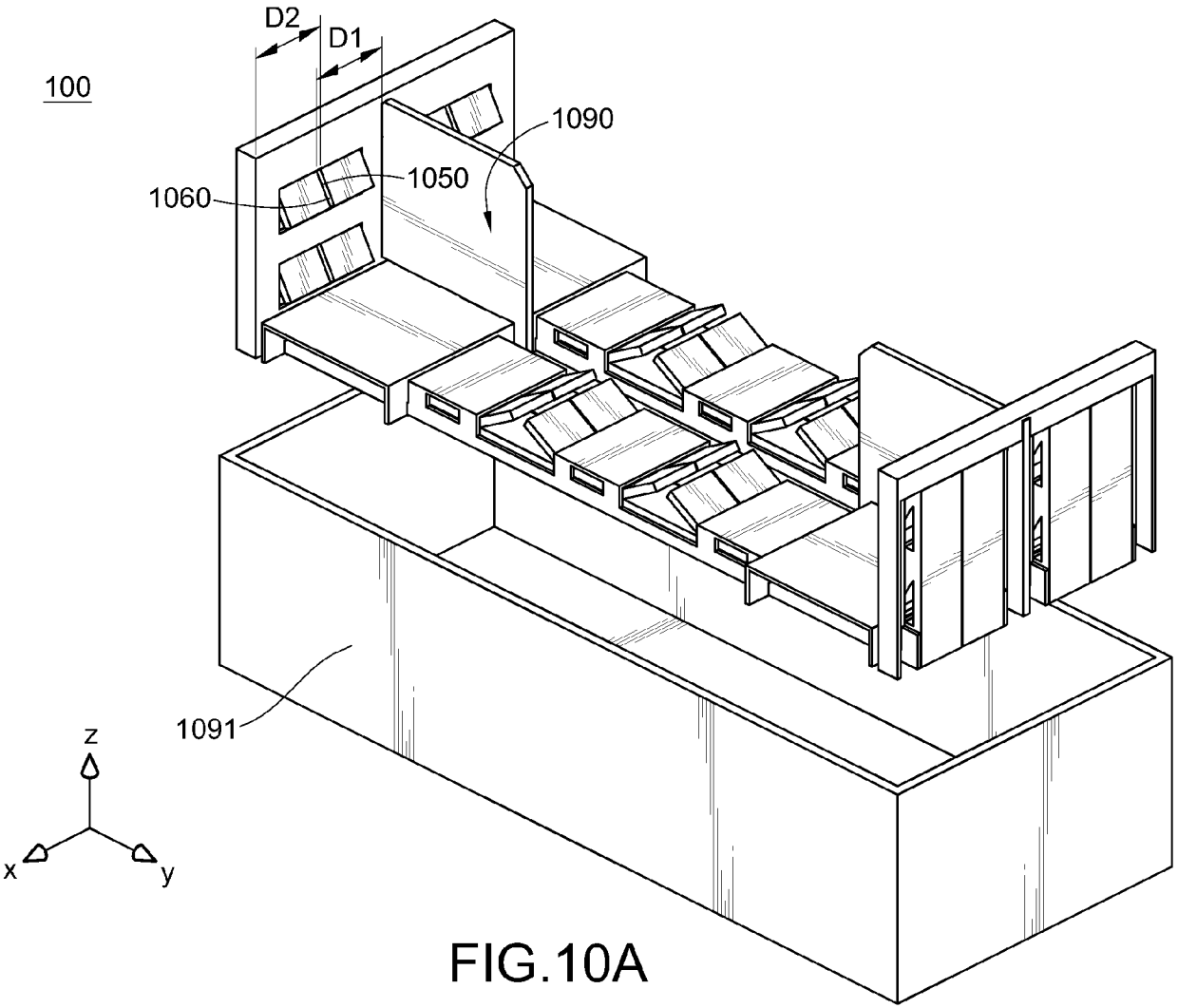
FIG. 10A depicts a perspective view of a protective structure according to another embodiment of the disclosure.
Figure 10B:
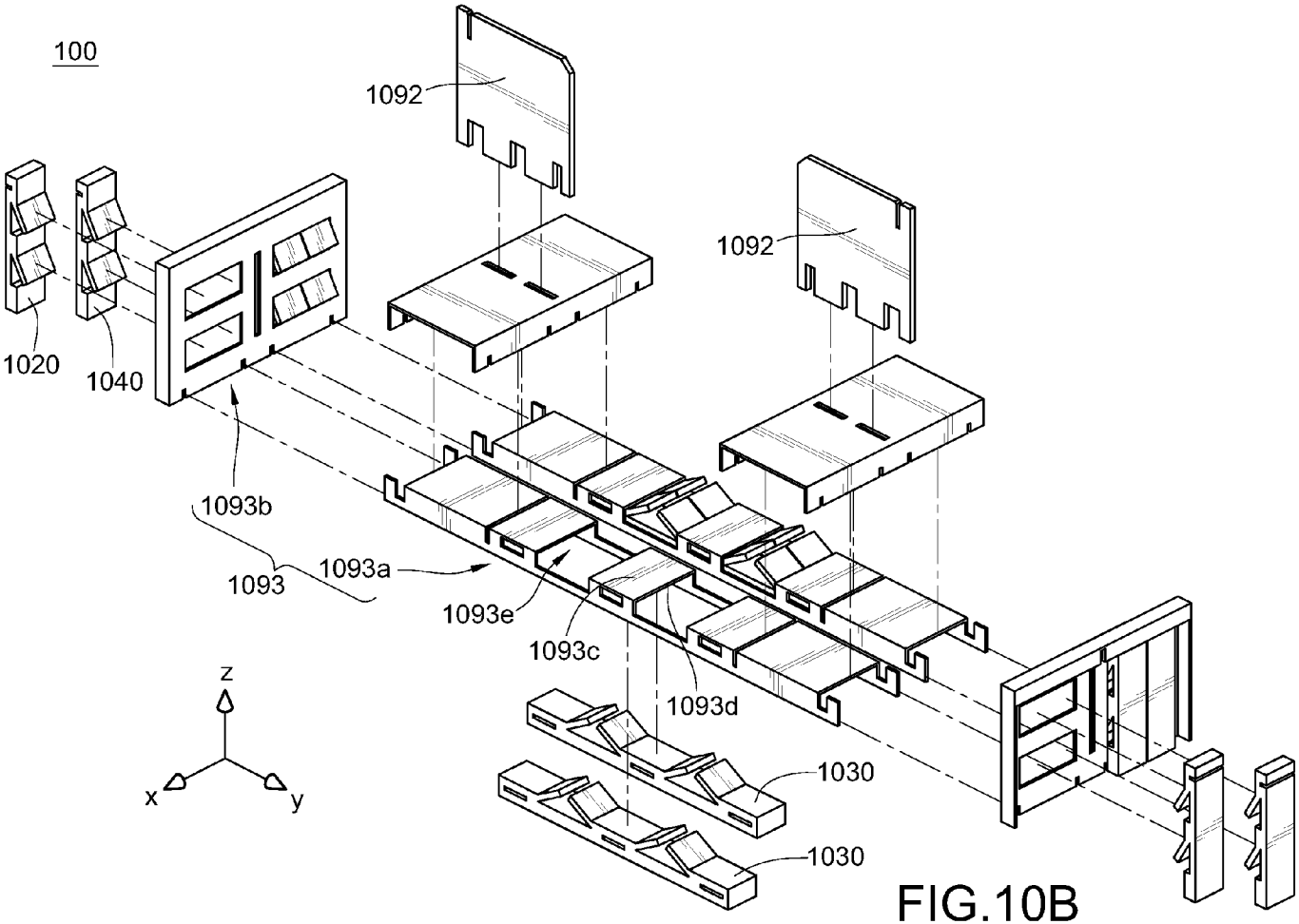
FIG. 10B depicts an exemplary perspective view of the protective structure in FIG. 10A.

Please refer to FIGS. 10A and 10B, FIG. 10A depicts a perspective view of a protective structure according to another embodiment of the disclosure, and FIG. 10B depicts an exemplary perspective view of the protective structure in FIG. 10A. A protective structure 100 comprise a bottom separating element 1093, a first side separating element 1091, a second side separating element 1092, multiple first blocking element 1010, multiple second blocking element 1020, multiple third blocking element 1030 and multiple fourth blocking element 1040. The bottom separating element 1093 includes a first surface 1093*c* and a second surface 1093*d* opposite to each other. The bottom separating element 1093 further comprises multiple through hole 1093*e* penetrating through the first surface 1093*c* and the second surface 1093*d*. The first side separating element 1091 and the second side separating element 1092 are disposed on two opposite sides of the bottom separating element 1093 along the X-Axis direction, respectively. Besides, the first side separating element 1091, the second side separating element 1092 and the first surface 1093*c* form a container 1090 together. The first blocking element 1010, the second blocking element 1020, the third blocking element 1030 and the fourth blocking element 1040 are all disposed on the second surface 1093*d*.

The shape of the container 1090 is L shape. The bottom separating element 1093 includes an L-shaped level part 1093*a* and an L-shaped standing part 1093*b*. The first blocking element 1010 and the third blocking element 1030 are disposed on the L-shaped level part 1093*a*. The second blocking element 1020 and the fourth blocking element 1040 are disposed on the L-shaped standing part 1093*b*. The first blocking element 1010 and the second blocking element 1020 include an edge 1050 in the vicinity of the second side separating element 1092, respectively. The edges 1050 keep a distance D1 from the second side separating element 1092. A first workpiece may be disposed between the edges 1050 and the second side separating element 1092. That is, the length of the first workpiece is equaled to or less than the distance D1. In this embodiment, the first workpiece may be a display panel. The third blocking element 1030 and the fourth blocking element 1040 include an edge 1060 in the vicinity of the first side separating element 1091, respectively. The edges 1060 both keep another distance D2 from the first side separating element 1091. A second workpiece may be disposed between the edges 1060 and the first side separating element 1091. That is, the length of the second workpiece is equaled to or less than the distance D2. In some embodiments, the distance D1, D2 may be different from each other so that the thickness of the first workpiece may be different from that of the second workpiece. The first blocking element 1010, the second blocking element 1020, the third blocking element 1030 and the fourth blocking element 1040 may be selected from the group consisting of the blocking elements in FIGS. 1A to 8D and combinations thereof. In the embodiment shown in FIGS. 10A, 10B, 10C, the first blocking element 1010, the second blocking element 1020, the third blocking element 1030 and the fourth blocking element 1040 may be made up by the single or multiple blocking element 20 in FIG. 2A, but not limited to the embodiment. The materials of the bottom separating element 1093, the first side separating element 1091 and the second side separating element 1092 may be different from those of the first blocking element 1010, the second blocking element 1020, the third blocking element 1030 and the fourth blocking element 1040. For example, the bottom separating element 1093, the first side separating element 1091 and the second side separating element 1092 may be made of corrugated fiberboard. The first blocking element 1010, the second blocking element 1020, the third blocking element 1030 and the fourth blocking element 1040 may be made of foamed polymer.

Figure 10C:
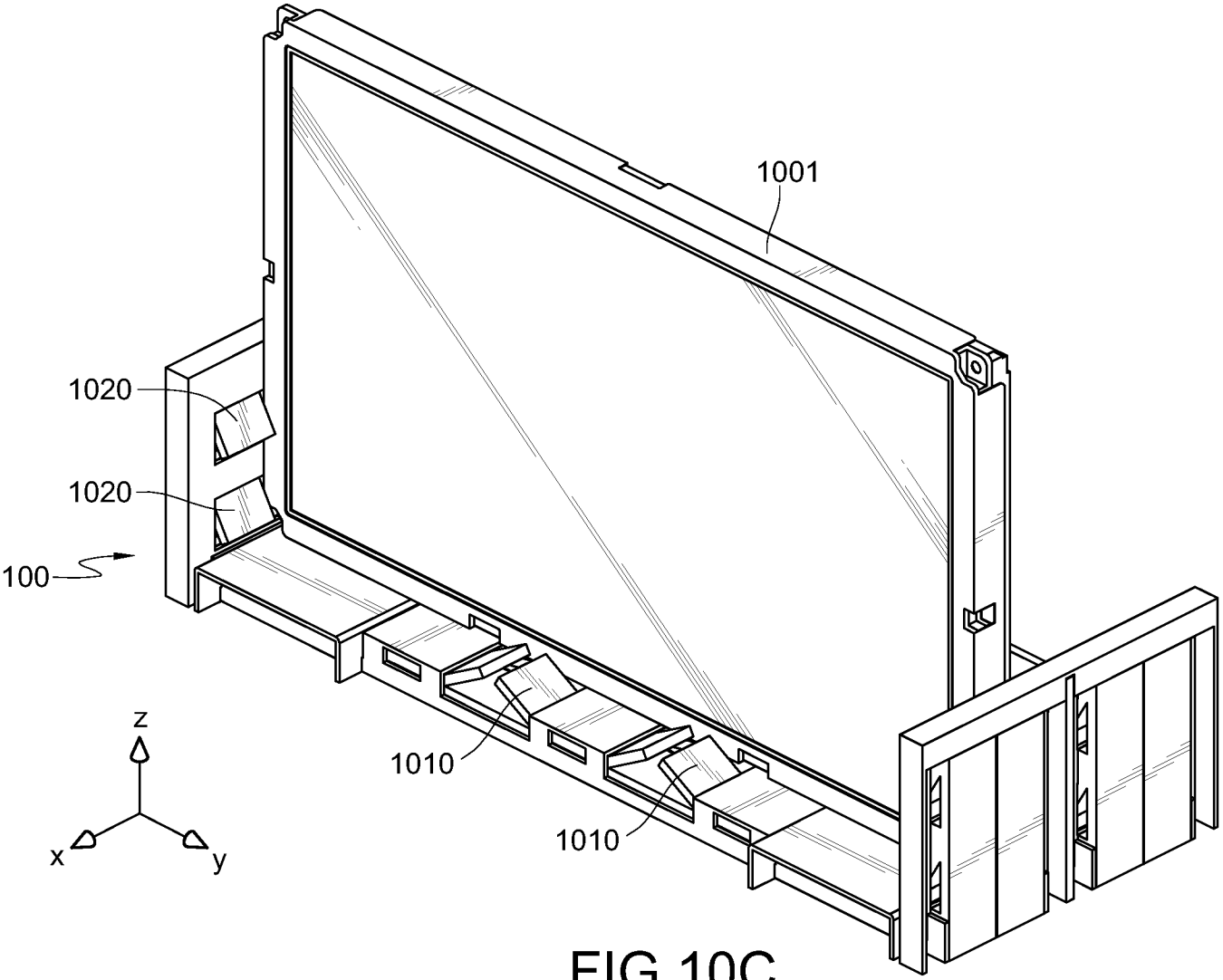
FIG. 10C depicts exemplary perspective views of using the protective structure in FIGS. 10A and 10B, respectively.

Please refer to FIGS. 10A to 10C, FIG. 10C depict exemplary perspective views of using the protective structure in FIGS. 10A and 10B. The first blocking element 1010, the second blocking element 1020, the third blocking element 1030 and the fourth blocking element 1040 are all disposed at a blocking position as well as multiple blocking parts of multiple blocking plates protrude from the first surface 1093*c* before a first workpiece 1001 and a second workpiece (not shown) are disposed. During the disposing of the first workpiece 1001, the third blocking element 1030 and the fourth blocking element 1040 are pressed to a closing position by the first workpiece 1001 so that the first blocking element 1010 and the second blocking element 1020 are maintained at the blocking position to provide the supporting in X-Axis direction for the first workpiece 1001. In other words, the first workpiece 1001 may not be collapsed because of the support provided by the first blocking element 1010 and the second blocking element 1020. Afterwards, when the second workpiece is disposed in the container 1090 in which the first workpiece 1001 is disposed, the first workpiece 1001 does not interfere with the disposing of the second workpiece because of the support of the first blocking element 1010 and the second blocking element 1020. Moreover, in other embodiments, only the first blocking element 1010 and the second blocking element 1020 are disposed on the protective structure 100 without disposing the third blocking element 1030 and the fourth blocking element 1040, and the collapsing may be avoided as well. During the disposing of the first workpiece 1001, the first workpiece 1001 may be disposed between the first blocking element 1010 and the second side separating element 1092 or between the second blocking element 1020 and the second side separating element 1092. The length of the first workpiece 1001 is equaled to or less than the distance D1. At this moment, the first blocking element 1010 and the second blocking element 1020 may still provide the supporting in the X-Axis direction for the first workpiece 1001.

Therefore, in the protective structure 100 of the disclosure, the single container 1090 may contain multiple workpieces. Moreover, when the workpieces are contained in the single container 1090, the first workpiece 1001 which is disposed earlier does not collapse because of the support provided by the first blocking element 1010 and the second blocking element 1020. Thus, during disposing the second workpiece in the container 1090, the first workpiece 1001 does not interfere with the second workpiece so that the second workpiece may be disposed in the container 1090 smoothly. Take first workpiece 1001 and second workpiece as a display panel for example, when the first workpiece 1001 and the second workpiece are contained in the container 1090, a display screen of the first workpiece 1001 and that of the second workpiece may face to face to each other. Besides, in this embodiment, the bottom separating element 1093, the first side separating element 1091, the second side separating element 1092, the first blocking element 1010, the second blocking element 1020, the third blocking element 1030 and the fourth blocking element 1040 may be clasped with each other to be disposed on the protective structure 100, and each of them may be dissembled with each other in the same way. After the use of the protective structure 100, each of the above-mentioned elements may be dissembled and pressed to a flat plate, thereby saving the space for storage or recycling.

To sum up, the blocking element according to the disclosure enables the blocking plate to provide the lateral support. The protective structure according to the disclosure provides the container which may contain multiple workpieces and the blocking element is disposed in the container. According to the disclosure, when the multiple workpieces are disposed in the container of the protective structure in sequence, the one workpiece which is disposed earlier in the container does not collapse because of the lateral support provided by the blocking elements. Therefore, the protective structure may contain more workpieces using fewer materials in less space, and furthermore the workpieces which is disposed later may not be interfered with the workpieces disposed earlier so that the all workpieces may be disposed in the container smoothly. In addition, the protective structure according to the disclosure may be assembled by clasping multiple elements with each other and disassembled, thereby saving the space for storage or recycling.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A blocking element, comprising:

a base including a surface and a recession formed downwardly towards the surface;

a first blocking plate connected to a first cross-connect part of the recession wherein the first blocking plate is used for pivoting on the first cross-connect part to include a first blocking position and a first closing position, when the first blocking plate is at the first blocking position, a first blocking part of the first blocking plate protrudes from the surface, and when the first blocking plate is pressed towards the recession to the first closing position by an external force, at least one portion of the first blocking part is contained in the recession; and a second blocking plate connected to a second cross-connect part of the recession, wherein the second blocking plate is used for pivoting on the second cross-connect part to include a second blocking position and a second closing position, when the second blocking plate is at the second blocking position, a second blocking part protrudes from the surface, and when the second blocking plate is pressed towards the recession to the second closing position by another external force, at least one portion of the second blocking part is contained in the recession, wherein the first cross-connect part and the second cross-connect part are positioned on two opposite sides of the recession, respectively; and wherein the recession includes a bottom part, the first blocking plate includes a first bottom surface facing the bottom part, the second blocking plate includes a second bottom surface facing the bottom part, and the first bottom surface and the second bottom surface are connected to each other.

2. The blocking element according to claim 1, wherein the base includes a first layer and a second layer stacked with each other, the recession further includes a sidewall, the first layer forms the sidewall, the second layer forms the bottom part, and the first layer and the second layer are partially separated.

3. The blocking element according to claim 1, wherein the first blocking plate and the base are integrated into one piece.

4. The blocking element according to claim 1, wherein the first blocking plate is made of foamed polymer.

5. The blocking element according to claim 1, wherein the base is made of foamed polymer.

6. The blocking element according to claim 1, wherein the first cross-connect part is positioned on an intersection of the recession and the surface.

7. A protective structure, comprising:

a container including a bottom surface, a first lateral surface and a second lateral surface; and a blocking element, disposed on the bottom surface and including an edge in the vicinity of the second lateral surface wherein the edge keeps a distance from the second lateral surface, wherein the blocking element is used for containing a workpiece disposed between the edge and the second lateral surface, and the blocking element comprises:

a recession, formed downwardly towards the bottom surface; and a first blocking plate, connected to a first cross-connect part of the recession wherein the first blocking plate is used for pivoting on the first cross-connect part to include a first blocking position and a first closing position, when the first blocking plate is at the first blocking position, a first blocking part of the first blocking plate protrudes from the bottom surface, and when the first blocking plate is pressed towards the recession to the first closing position by an external force, at least one portion of the first blocking part is contained in the recession.

8. The protective structure according to claim 7, wherein the protective structure further comprises another blocking element disposed on the bottom surface and including another edge in the vicinity of the first lateral surface, the another edge keeps another distance from the first lateral surface, and another workpiece is disposed between the another edge and the first lateral surface.

9. The protective structure according to claim 7, wherein the shape of the container is L shape, the bottom surface includes an L-shaped level part and an L-shaped standing part, and the blocking element is disposed on the L-shaped level part.

10. The protective structure according to claim 9, wherein the protective structure further comprises another blocking element disposed on the L-shaped standing part of the bottom surface.

11. The protective structure according to claim 7, wherein the protective structure is integrated into one piece.

12. The protective structure according to claim 7, wherein the protective structure is made of foamed polymer.

13. The protective structure according to claim 7, wherein the shape and the size of the first blocking plate corresponds to the shape and the size of the recession.

14. The protective structure according to claim 7, wherein the first cross-connect part is positioned on the intersection of the recession and the bottom surface.

15. The protective structure according to claim 7, wherein the blocking element further comprises a second blocking plate connected to a second cross-connect part of the recession, the second blocking plate is used for pivoting on the second cross-connect part and includes a second blocking position and a second closing position in relative to the second cross-connect part, when the second blocking plate is at the second blocking position, the second blocking plate includes a second blocking part protruding from the bottom surface, when the second blocking plate is pressed towards the recession to the second closing position by another external force, at least one portion of the second blocking part is contained in the recession.

16. The protective structure according to claim 15, wherein the first cross-connect part and the second cross-connect part are disposed on two opposite sides of the recession, respectively.

17. The protective structure according to claim 16, wherein the recession includes a bottom part, the first blocking plate includes a first bottom surface facing the bottom part, the second blocking plate includes a second bottom surface facing the bottom part, and the first bottom surface and the second bottom surface are connected to each other.

* * * * *